US011639813B2

(12) United States Patent
Hasegawa et al.

(10) Patent No.: US 11,639,813 B2
(45) Date of Patent: May 2, 2023

(54) WATER HEATING APPARATUS AND WATER HEATING SYSTEM

(71) Applicant: NORITZ CORPORATION, Hyogo (JP)

(72) Inventors: Takahide Hasegawa, Kakogawa (JP); Atsushi Ushio, Akashi (JP)

(73) Assignee: NORITZ CORPORATION, Hyogo (JP)

( * ) Notice: Subject to any disclaimer, the term of this patent is extended or adjusted under 35 U.S.C. 154(b) by 273 days.

(21) Appl. No.: 15/930,622

(22) Filed: May 13, 2020

(65) Prior Publication Data

US 2020/0400346 A1 Dec. 24, 2020

(30) Foreign Application Priority Data

Jun. 24, 2019 (JP) ..... JP2019-116282

(51) Int. Cl.
*F24H 4/02* (2022.01)
*E03B 7/04* (2006.01)
(Continued)

(52) U.S. Cl.
CPC ..... *F24H 4/02* (2013.01); *E03B 7/045* (2013.01); *F24D 19/1054* (2013.01);
(Continued)

(58) Field of Classification Search
CPC ..... E03B 7/045; F24H 4/02; F24H 9/2035; F24D 19/1054; F24D 2220/044; F24D 2220/042; E03C 1/044; E03C 1/0411
See application file for complete search history.

(56) References Cited

U.S. PATENT DOCUMENTS 6,536,464 B1 3/2003 Lum et al.
10,393,558 B2 * 8/2019 Hogendoorn ..... G01F 1/74
(Continued)

FOREIGN PATENT DOCUMENTS

JP H06-249509 A 9/1994
JP H06249507 A 9/1994
(Continued)

OTHER PUBLICATIONS

An Office Action; "Notice of Reasons for Refusal," mailed by the Japanese Patent Office dated Feb. 14, 2023, which corresponds to Japanese Patent Application No. 2019-116282 and is related to U.S. Appl. No. 15/930,622; with English language translation.

*Primary Examiner* — Steven B McAllister
*Assistant Examiner* — John E Bargero
(74) *Attorney, Agent, or Firm* — Studebaker & Brackett PC

(57) ABSTRACT

In an immediate hot water supply operation mode in which a circulation pump is activated while a hot water supply faucet is closed, a water heating apparatus forms an immediate hot water supply circulation path by an inner path including a water entry path, a heat exchanger, and a hot water output path and an outer path bypassing the hot water supply faucet, as being combined. A controller stores as an actual flow rate value for each immediate hot water supply operation mode, a flow rate detection value by a flow rate sensor at predetermined timing, and calculates a flow rate learning value based on a plurality of stored actual flow rate values. When the flow rate detection value becomes larger than a criterion value set in accordance with the flow rate learning value, use of the hot water supply faucet is detected and the circulation pump is deactivated.

13 Claims, 9 Drawing Sheets

(51) Int. Cl.
*F24D 19/10* (2006.01)
*F24H 9/20* (2022.01)

(52) U.S. Cl.
CPC ..... *F24H 9/2035* (2013.01); *F24D 2220/042* (2013.01); *F24D 2220/044* (2013.01)

(56) References Cited

U.S. PATENT DOCUMENTS

| | | | | |
|---|---|---|---|---|
| 2014/0229022 | A1* | 8/2014 | Deivasigamani .... | G05D 7/0629 700/282 |
| 2016/0186415 | A1* | 6/2016 | Yuge ..... | F24D 17/0078 137/340 |
| 2017/0234578 | A1* | 8/2017 | Sato ..... | F24H 1/145 165/11.1 |
| 2017/0299222 | A1* | 10/2017 | Cho ..... | F24H 1/22 |
| 2018/0038616 | A1* | 2/2018 | Scheers ..... | F24H 9/2028 |

FOREIGN PATENT DOCUMENTS

| | | | |
|---|---|---|---|
| JP | H11159869 | A | 6/1999 |
| JP | 2004286397 | A | 10/2004 |
| JP | 2005-241214 | A | 9/2005 |
| JP | 2016-125692 | A | 7/2016 |

* cited by examiner

| | LOW-TEMPERATURE STATE | HIGH-TEMPERATURE STATE |
|---|---|---|
| WHILE FAUCET IS OPEN | 201→203(Pa), 202→204(Pb) | |
| WHILE FAUCET IS CLOSED | 201→202(Pc) | CLOSED |

WATER HEATING APPARATUS AND WATER HEATING SYSTEM

BACKGROUND OF THE INVENTION

Field of the Invention

The present disclosure relates to a water heating apparatus and a water heating system and more particularly to a water heating apparatus with an immediate hot water supply function and a water heating system.

Description of the Background Art

A water heating apparatus of one form is equipped with what is called an immediate hot water supply function for outputting hot water at an appropriate temperature immediately after start of hot water supply even after hot water supply has been off for a long period of time. Normally, in order to achieve the immediate hot water supply function, a mode in which a circulation path that goes through a heat source also while hot water supply is off is formed (an "immediate hot water supply operation mode" below) should be provided.

Japanese Patent Laying-Open No. 6-249507 discloses a configuration of a temperature-maintained circulation water heating apparatus that detects a flow rate in temperature-maintained circulation and a flow rate in hot water output with a single flow rate sensor and reliably detects use of a hot water supply faucet even in output of a small amount of hot water.

U.S. Pat. No. 6,536,464 discloses a configuration for forming a circulation path for the immediate hot water supply function by externally connecting a bypass valve (which is also referred to as a "crossover valve" below) for thermostatic control using a wax thermostatic element. The immediate hot water supply function can thus be achieved by simplified attachment works without adding a function to control the crossover valve on a side of the water heating apparatus.

SUMMARY OF THE INVENTION

According to Japanese Patent Laying-Open No. 6-249507, a flow rate value on which determination as hot water supply use is based (a flow rate in hot water supply use) is different between an active state and an inactive state of a circulation pump. This publication describes registration in advance of a circulation flow rate at the time when a length of disposed hot water supply path and return path is shortest as a provisional flow rate for the flow rate in hot water supply use in the active state of the circulation pump, detection thereafter of the circulation flow rate in a temperature-maintained circulation operation, and update of the circulation flow rate based on an actually detected circulation flow rate.

According to the configuration in Japanese Patent Laying-Open No. 6-249507, however, it is a concern that accuracy in detection of use of a hot water supply faucet is lowered when a condition of the circulation flow path formed while the circulation pump is active changes over time. In particular, it is a concern in an example where the circulation flow path is formed by connection of a crossover valve as described in U.S. Pat. No. 6,536,464 that above-described change over time tends to occur.

The present disclosure was made to solve such problems, and an object of the present disclosure is to improve accuracy in detection of use of a hot water supply faucet in an immediate hot water supply operation mode.

According to one aspect of the present disclosure, a water heating apparatus that outputs hot water to a hot water supply faucet includes a water entry port to which low-temperature water is introduced, a heating mechanism, a hot water output port for output of high-temperature water heated by the heating mechanism, a water entry path, a hot water output path, a flow rate detector, and a controller. The water entry path is formed between the water entry port and the heating mechanism. The hot water output path is formed between the heating mechanism and the hot water output port. In an immediate hot water supply operation mode in which a circulation pump is activated while the hot water supply faucet is closed, the water heating apparatus is configured to form an immediate hot water supply circulation path through which fluid passes through the heating mechanism by an inner path and an outer path as being combined, the inner path including at least a part of the water entry path, the heating mechanism, and the hot water output path, the outer path bypassing the hot water supply faucet on the outside of the water heating apparatus. The flow rate detector detects a flow rate in the immediate hot water supply circulation path. The controller gives an instruction to activate and deactivate the heating mechanism and the circulation pump. The controller stores for each immediate hot water supply operation mode, a flow rate detection value obtained by the flow rate detector at predetermined timing in the immediate hot water supply operation mode, and calculates a flow rate learning value based on a plurality of stored flow rate detection values. When the flow rate detection value becomes larger than a criterion value set in accordance with the flow rate learning value in the immediate hot water supply operation mode, the controller detects use of the hot water supply faucet and deactivates the circulation pump.

According to another aspect of the present disclosure, a water heating system includes a water heating apparatus including a water entry port and a hot water output port, a low-temperature water pipe, a high-temperature water pipe, and a circulation pump. The low-temperature water pipe introduces low-temperature water to a water entry port of the water heating apparatus. The high-temperature water pipe connects the hot water output port of the water heating apparatus and the hot water supply faucet to each other. The circulation pump is arranged inside or outside the water heating apparatus. The water heating apparatus includes a heating mechanism, a water entry path formed between the water entry port and the heating mechanism, a hot water output path formed between the heating mechanism and the hot water output port, a flow rate detector, and a controller that gives an instruction to activate and deactivate the heating mechanism and the circulation pump. In an immediate hot water supply operation mode in which the circulation pump is activated while the hot water supply faucet is closed, the water heating apparatus is configured to form an immediate hot water supply circulation path through which fluid passes through the heating mechanism by an inner path and an outer path as being combined, the inner path including at least a part of the water entry path, the heating mechanism, and the hot water output path, the outer path bypassing the hot water supply faucet on the outside of the water heating apparatus. The flow rate detector detects a flow rate in the immediate hot water supply circulation path. The controller stores for each immediate hot water supply operation mode, a flow rate detection value obtained by the flow rate detector at predetermined timing in the immediate hot water supply operation mode, and calculates a flow rate learning value based on a plurality of stored flow rate detection values. When the flow rate detection value becomes larger than a criterion value set in accordance with the flow rate learning value in the immediate hot water supply operation mode, the controller detects use of the hot water supply faucet and deactivates the circulation pump.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
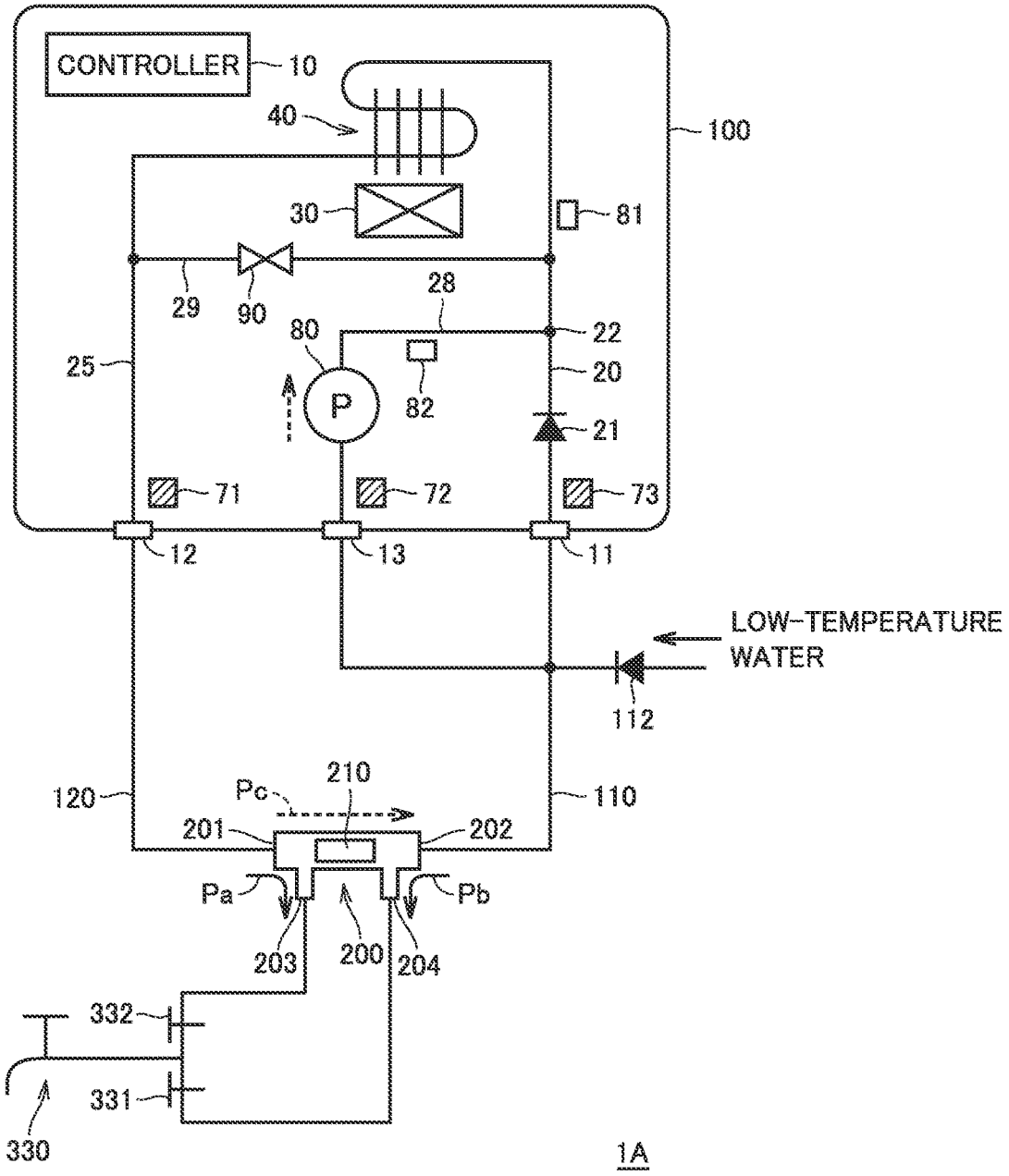
FIG. 1 is a block diagram illustrating a configuration of a water heating system including a water heating apparatus according to the present embodiment.

An embodiment of the present disclosure will be described in detail below with reference to the drawings. The same or corresponding elements in the drawings below have the same reference characters allotted and description thereof will not be repeated in principle.

FIG. 1 is a block diagram illustrating a configuration of a water heating system 1A including a water heating apparatus according to the present embodiment.

Referring to FIG. 1, water heating system 1A includes a water heating apparatus 100, a low-temperature water pipe 110, a high-temperature water pipe 120, and a crossover valve 200. Water heating apparatus 100 includes a water entry port 11, a hot water output port 12, and a circulation port 13.

Low-temperature water pipe 110 is supplied with low-temperature water through a check valve 112. Low-temperature water is representatively supplied from a not-shown water supply pipe. Low-temperature water pipe 110 is connected to water entry port 11 and circulation port 13.

Water heating apparatus 100 includes a controller 10, a water entry path 20, a hot water output path 25, a circulation path 28, a bypass path 29, a combustion mechanism 30, a heat exchanger 40, a circulation pump 80, and a flow rate regulation valve 90.

Water entry path 20 is formed between water entry port 11 and an input side (upstream side) of heat exchanger 40 with a check valve 21 being interposed. Combustion mechanism 30 is representatively implemented by a burner that generates a quantity of heat by combustion of fuel such as gas or petroleum or the like.

Heat exchanger 40 increases a temperature of low-temperature water (fluid) introduced through water entry path 20 by using the quantity of heat generated by combustion mechanism 30. Therefore, combustion mechanism 30 and heat exchanger 40 can implement an embodiment of the "heating mechanism." Alternatively, the "heating mechanism" can also be implemented by a heat pump or exhaust heat during power generation.

Hot water output path 25 is formed between an output side (downstream side) of heat exchanger 40 and hot water output port 12. Bypass path 29 connects water entry path 20 and hot water output path 25 to each other without heat exchanger 40 being interposed. Under the control of flow rate regulation valve 90 by controller 10, a ratio of a flow rate in bypass path 29 (a bypass flow rate ratio) to a total flow rate (the sum of a flow rate in heat exchanger 40 and a flow rate in bypass path 29) can be regulated.

According to such a bypass configuration, some of low-temperature water bypasses heat exchanger 40 and is mixed without being heated, in a portion downstream from heat exchanger 40, and thus high-temperature water is supplied from hot water output port 12. Since a temperature of output from heat exchanger 40 (heating mechanism) can thus be high, drainage water generated by cooling of exhaust from combustion mechanism 30 at a surface of heat exchanger 40 is advantageously suppressed.

A flow rate sensor 81 that outputs a value of a flow rate of low-temperature water is arranged in water entry path 20 and a flow rate sensor 82 is arranged in circulation path 28. Flow rate sensor 81 is arranged to be included in an immediate hot water supply circulation path which will be described later. Detection values from flow rate sensors 81 and 82 are input to controller 10.

A temperature sensor 71 is arranged in hot water output path 25 and a temperature sensor 73 is arranged in water entry path 20. A temperature sensor 72 is arranged in circulation path 28. Fluid temperatures detected by temperature sensors 71 to 73 are input to controller 10.

Figures 2, 3:
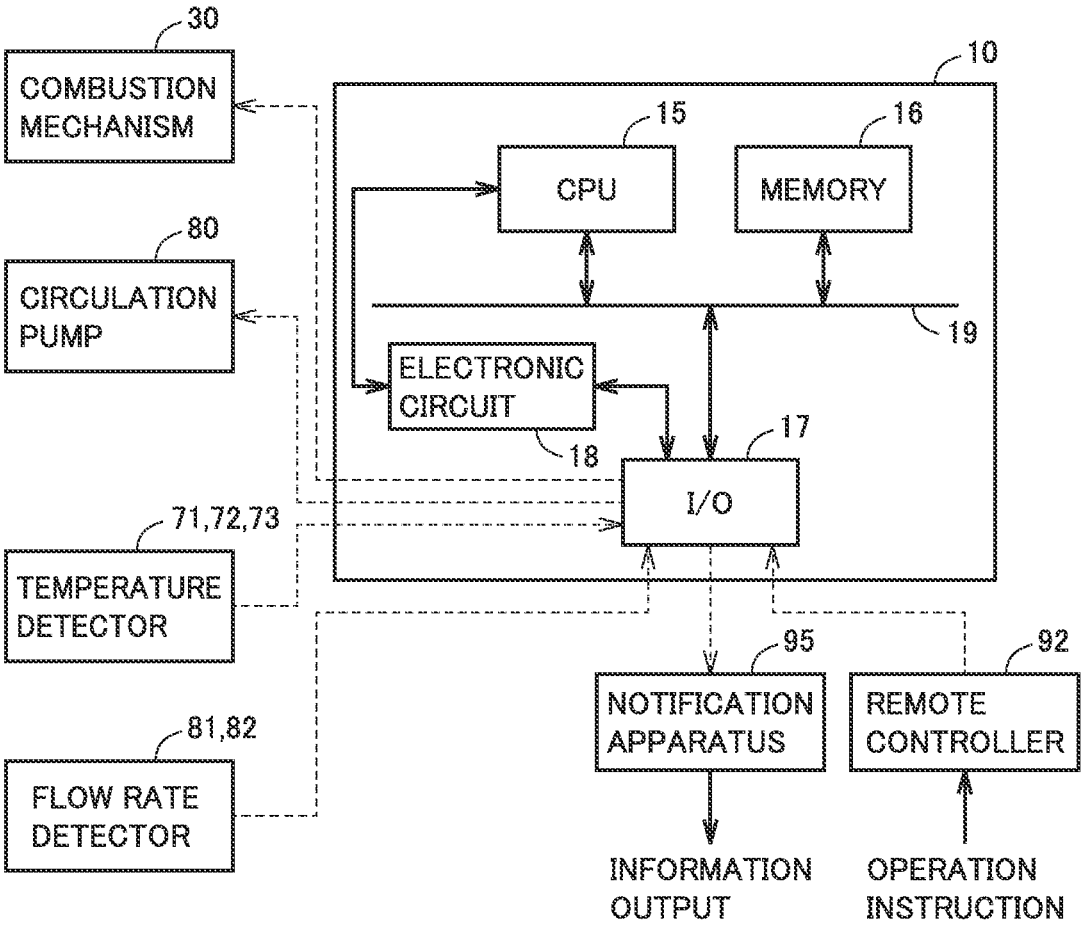
FIG. 2 is a block diagram illustrating an exemplary hardware configuration of a controller shown in FIG. 1.
FIG. 3 shows a chart illustrating switching between flow paths by means of a crossover valve shown in FIG. 1.

FIG. 2 is a block diagram illustrating an exemplary hardware configuration of controller 10.

Referring to FIG. 2, controller 10 is representatively implemented by a microcomputer. Controller 10 includes a central processing unit (CPU) 15, a memory 16, an input and output (I/O) circuit 17, and an electronic circuit 18. CPU 15, memory 16, and I/O circuit 17 can transmit and receive signals to one another through a bus 19. Electronic circuit 18 is configured to perform prescribed operation processing with dedicated hardware. Electronic circuit 18 can transmit and receive signals to and from CPU 15 and I/O circuit 17.

CPU 15 receives output signals (detection values) from sensors including temperature sensors 71 to 73 and flow rate sensors 81 and 82 through I/O circuit 17. CPU 15 further receives a signal indicating an operation instruction input to a remote controller 92 through I/O circuit 17. The operation instruction includes, for example, an operation to switch on and off an operation switch of water heating apparatus 100, a set hot water supply temperature, and various types of programmed time setting (which is also referred to as "timer setting"). CPU 15 controls operations by constituent apparatuses including combustion mechanism 30 and circulation pump 80 such that water heating apparatus 100 operates in accordance with the operation instruction.

CPU 15 can output visually or aurally recognizable information by controlling a notification apparatus 95. For example, notification apparatus 95 can output information by showing visually recognizable information such as characters and graphics on a screen. In this case, notification apparatus 95 can be implemented by a display screen provided in remote controller 92. Alternatively, notification apparatus 95 may be implemented by a speaker so that information can also be output by voice and sound or melodies.

Operations by water heating apparatus 100 will be described with reference to FIG. 1 again.

In use for hot water supply in which a hot water supply faucet 330 is open, low-temperature water is introduced into water entry path 20 by a supply pressure of low-temperature water. When flow rate sensor 81 detects a flow rate exceeding a minimum operating quantity (MOQ) of working water while the operation switch of water heating apparatus 100 is on, controller 10 activates combustion mechanism 30.

Consequently, high-temperature water heated by combustion mechanism 30 and heat exchanger 40 is mixed with low-temperature water that passes through bypass path 29 and thereafter output to high-temperature water pipe 120 through hot water output port 12.

During a normal hot water supply operation, controller 10 deactivates circulation pump 80 and controls a temperature of fluid (hot water output temperature Th) detected by temperature sensor 71 to a set hot water supply temperature Tr input to remote controller 92. Specifically, a temperature of hot water output can be controlled based on combination of control of a quantity of heating (a quantity of generated heat) by combustion mechanism 30 (heating mechanism) and control of the bypass flow rate ratio by means of flow rate regulation valve 90.

Circulation path 28 is formed between circulation port 13 and water entry path 20 (a connection point 22). Circulation pump 80 is connected to circulation path 28. Alternatively, circulation pump 80 may be connected to circulation port 13 on the outside of water heating apparatus 100. Activation and deactivation of circulation pump 80 are controlled by controller 10.

While the hot water supply operation is off, a temperature of fluid that remains in hot water output path 25 and high-temperature water pipe 120 is lowered. Therefore, there is a concern about a long time period required until supply of high-temperature water to hot water supply faucet 330 after start of the next hot water supply operation. Therefore, water heating apparatus 100 is provided with an immediate hot water supply function for promptly supplying high-temperature water after start of the hot water supply operation. The immediate hot water supply function is performed by forming an immediate hot water supply circulation path including combustion mechanism 30 and heat exchanger 40 by activation of circulation pump 80 while the faucet is closed, that is, while hot water supply faucet 330 is closed.

For example, a user can designate by timer setting, a period for which the immediate hot water supply operation is to be performed. Timer setting can be input, for example, by operating remote controller 92. Alternatively, the period for which the immediate hot water supply operation is to be performed may automatically be set based on learning of a history of use by the user in the past. Alternatively, the period for which the immediate hot water supply operation is performed can also be started or ended directly in response to a switch operation by the user.

In water heating system 1A, the immediate hot water supply operation mode with activation of circulation pump 80 can be executed by using crossover valve 200. Crossover valve 200 is configured similarly to the thermostatically controlled bypass valve described in U.S. Pat. No. 6,536,464 and includes ports 201 to 204 and a wax thermostatic element 210. Ports 201 and 203 internally communicate with each other and ports 202 and 204 internally communicate with each other. Wax thermostatic element 210 is connected between ports 201 and 203 and ports 202 and 204.

Wax thermostatic element 210 forms a thermal bypass path between ports 201 and 203 and ports 202 and 204 in a low-temperature state. Wax thermostatic element 210 closes the thermal bypass path owing to thermal expansion force in a high-temperature state. A switching temperature at which switching between formation and closing of the thermal bypass path is made is designed in advance depending on a material and a configuration of wax thermostatic element 210. A state that a fluid temperature in crossover valve 200 is higher than the switching temperature is also referred to as a high-temperature state and a state that the fluid temperature is lower than the switching temperature is also referred to as a low-temperature state below.

Crossover valve 200 thus corresponds to an embodiment of the "thermal water stop bypass valve." A pressure loss in the thermal bypass path is designed to be higher than a pressure loss in each of a path through which ports 201 and 203 communicate with each other and a path through which ports 202 and 204 communicate with each other.

Port 201 is connected to high-temperature water pipe 120 and port 202 is connected to low-temperature water pipe 110. Ports 203 and 204 are connected to hot water supply faucet 330. Hot water supply faucet 330 is provided as a combination faucet in which high-temperature water from port 203 and low-temperature water from port 204 are mixed. Valves 331 and 332 for adjustment of a ratio of mixing between high-temperature water and low-temperature water can be provided between port 204 and hot water supply faucet 330 and between port 203 and hot water supply faucet 330, respectively.

FIG. 3 shows a chart illustrating switching between flow paths by means of crossover valve 200 shown in FIG. 1.

Referring to FIGS. 3 and 1, while the faucet is open, that is, while paths from ports 203 and 204 to hot water supply faucet 330 are formed, due to the pressure loss described above, in each of the high-temperature state and the low-temperature state, a flow path Pa between high-temperature water pipe 120 and hot water supply faucet 330 and a flow path Pb between low-temperature water pipe 110 and hot water supply faucet 330 are formed.

While the faucet is closed, that is, while the paths from ports 203 and 204 to hot water supply faucet 330 are cut off, the flow path is switched between the low-temperature state and the high-temperature state. In the low-temperature state, a thermal bypass path Pc is formed between ports 201 and 202, that is, between high-temperature water pipe 120 and low-temperature water pipe 110, through a thermal bypass path formed in wax thermostatic element 210. In the high-temperature state, the thermal bypass path is closed so that the flow path between high-temperature water pipe 120 and low-temperature water pipe 110 is cut off.

In the hot water supply operation, in water heating system 1A, high-temperature water is obtained by heating of low-temperature water introduced into water entry port 11 through low-temperature water pipe 110 by combustion mechanism 30 and heat exchanger 40 (heating mechanism). High-temperature water is output from hot water supply faucet 330 through hot water output port 12 and high-temperature water pipe 120 as well as crossover valve 200 (flow path Pa).

In the immediate hot water supply operation mode, as circulation pump 80 is activated, a fluid path (outer path) from hot water output port 12 through high-temperature water pipe 120, crossover valve 200 (thermal bypass path Pc), and low-temperature water pipe 110 to circulation port 13 can be formed on the outside of water heating apparatus 100. In addition, in the inside of water heating apparatus 100, a fluid path (an inner path) including circulation port 13, circulation path 28, water entry path 20 (on the downstream side of connection point 22), heat exchanger 40 (heating mechanism), hot water output path 25, and hot water output port 12 can be formed. By forming the immediate hot water supply circulation path by the inner path and the outer path as such, high-temperature water flows through the immediate hot water supply circulation path also while the faucet is closed, so that high-temperature water can be supplied to hot water supply faucet 330 from immediately after the faucet is opened.

In the configuration in which water heating apparatus 100 includes the bypass configuration (bypass path 29 and flow rate regulation valve 90), the bypass flow rate ratio in the immediate hot water supply operation mode is preferably fixed to a predetermined identical value. In particular, a pressure loss in the thermal bypass path formed by wax thermostatic element 210 is high. Therefore, in consideration of a low flow rate in the immediate hot water supply circulation path including crossover valve 200, in the immediate hot water supply operation mode, flow rate regulation valve 90 is preferably controlled to maintain the bypass flow rate ratio to a minimum value (including a value when the valve is fully closed).

In the present embodiment, the description proceeds below assuming that a bypass ratio r ($0 \leq r < 1.0$) in water heating apparatus 100 in the immediate hot water supply operation mode is controlled to $r=0$ by fully closing flow rate regulation valve 90. In this case, a flow rate in the immediate hot water supply circulation path is equal to a flow rate detection value obtained by flow rate sensor 81. When bypass ratio r is not equal to 0 ($r \neq 0$) as well, by correcting a flow rate detection value Q obtained by flow rate sensor 81 by a factor of $1/(1-r)$ by using a bypass ratio in accordance with opening of flow rate regulation valve 90 at that time, control processing as will be described later can be applied.

When hot water supply faucet 330 is used in the immediate hot water supply operation mode, circulation pump 80 is preferably deactivated. As described above, in the normal hot water supply operation, circulation pump 80 is inactive. Therefore, when hot water is supplied while circulation pump 80 is maintained active, the supply pressure of low-temperature water through flow path Pb (FIG. 1) is lower than in the normal hot water supply operation. Consequently, when balance between the pressure of high-temperature water and the pressure of low-temperature water is varied in hot water supply faucet 330 as compared with balance in the normal hot water supply operation, a temperature of output from hot water supply faucet 330 changes due to change in balance of mixing between high-temperature water and low-temperature water, which leads to a concern about lowering in usability by a user. Therefore, it is required to accurately detect start of use of hot water supply faucet 330 (which is also referred to as "hot water supply interrupt" below) in the immediate hot water supply operation.

Referring again to FIG. 1, in general, in the configuration in which circulation path 28 is provided, in the immediate hot water supply operation mode, a difference between a flow rate detected by flow rate sensor 82 and a flow rate detected by flow rate sensor 81 changes in response to activation of circulation pump 80, and the difference is different between before and after opening of hot water supply faucet 330. Therefore, hot water supply interrupt in the immediate hot water supply operation mode can be detected based on a difference in flow rate detected by flow rate sensors 81 and 82.

In the configuration in which crossover valve 200 is connected, however, a pressure loss in the thermal bypass path formed by wax thermostatic element 210 is high as described above and hence the flow rate detected by flow rate sensor 82 in the immediate hot water supply operation mode is low. Therefore, the difference in flow rate detected by flow rate sensors 81 and 82 is not much different between before and after opening of hot water supply faucet 330. Accordingly, it is difficult to accurately detect hot water supply interrupt based on a difference in flow rate detected by flow rate sensors 81 and 82.

In consideration of such an aspect, in the present embodiment, use of hot water supply faucet 330 in the immediate hot water supply operation mode, that is, hot water supply interrupt, is detected as below.

Figure 4:
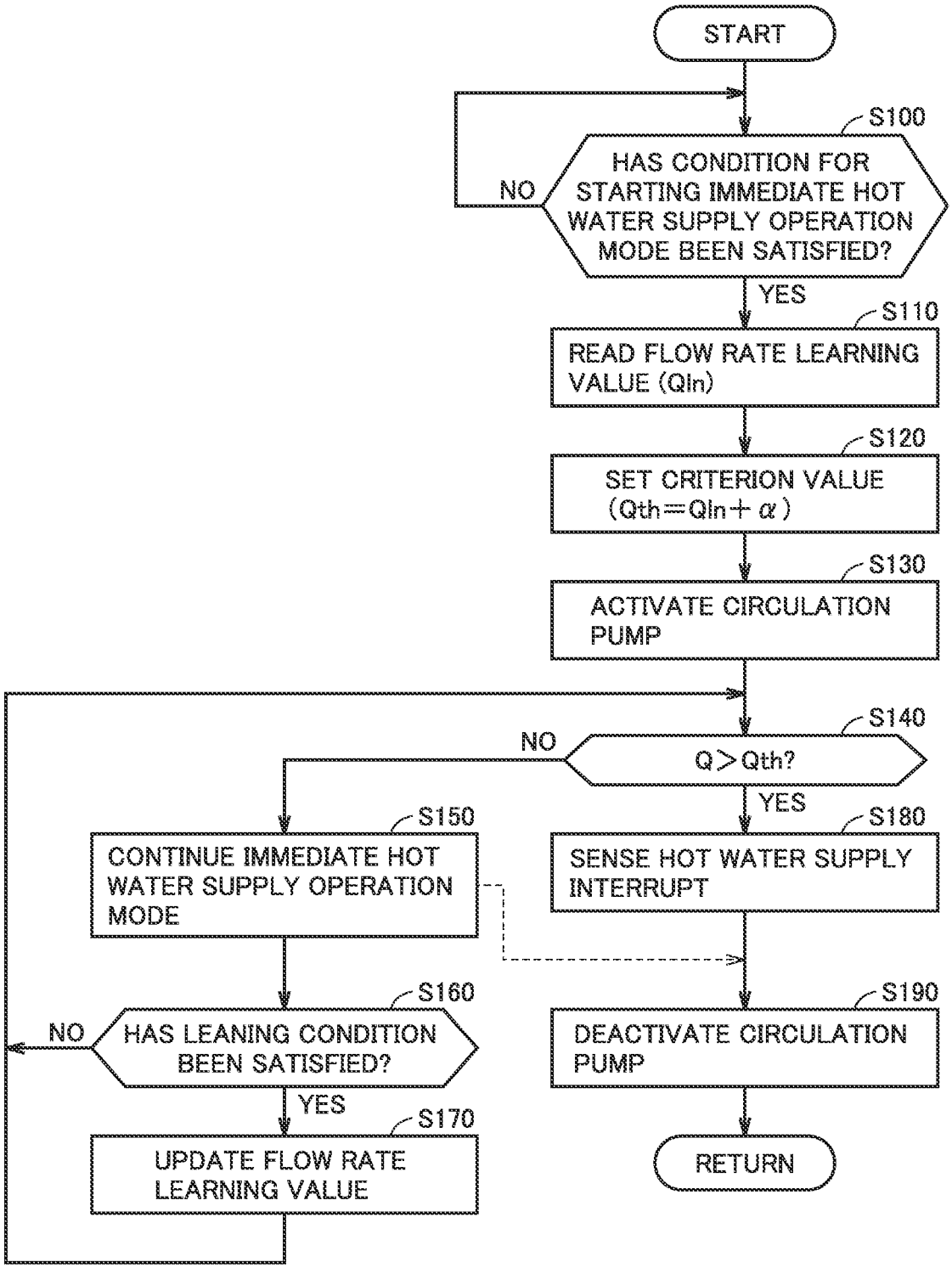
FIG. 4 is a flowchart illustrating control processing in an immediate hot water supply operation mode by the water heating apparatus according to the present embodiment.

FIG. 4 is a flowchart illustrating control processing in the immediate hot water supply operation mode by the water heating apparatus according to the present embodiment. Control processing shown in FIG. 4 is repeatedly performed by controller 10 during a period provided by timer setting or the like for which the immediate hot water supply operation is performed.

Referring to FIG. 4, controller 10 determines in a step (which is simply also denoted as "S" below) 100, whether or not a condition for starting the immediate hot water supply operation mode has been satisfied. For example, the start condition is satisfied when a temperature detected by temperature sensor 71 is lower than a predetermined temperature while the hot water supply operation is off (while the faucet is closed).

When the start condition has been satisfied (determination as YES in S100), controller 10 starts the immediate hot water supply operation mode by starting up processing in S110 or later. When the start condition has not been satisfied (determination as NO in S100), processing in S110 or later is not started up.

When controller 10 activates circulation pump 80 in S130, the immediate hot water supply circulation path described above is formed in water heating system 1A. Combustion mechanism 30 is ready for activation in the immediate hot water supply operation mode, and it is activated and generates a quantity of heat while flow rate sensor 81 detects a flow rate exceeding a minimum operating quantity (MOQ) of working water.

When circulation pump 80 is activated (S130), in S110, controller 10 reads a flow rate learning value Qln in the immediate hot water supply operation mode, and in S120, controller 10 sets a criterion value Qth for detection of hot water supply interrupt in accordance with read flow rate learning value Qln.

In the immediate hot water supply operation mode in which circulation pump 80 is active, in S140, controller 10 determines whether or not hot water supply interrupt is occurring based on comparison between a flow rate detection value Q obtained by flow rate sensor 81 and criterion value Qth set in S120.

While flow rate detection value Q does not exceed criterion value Qth (determination as NO in S140), the immediate hot water supply operation mode is continued in S150. While the immediate hot water supply operation mode is continued, controller 10 determines in S160 whether or not a condition for learning of the flow rate has been satisfied. When the learning condition has been satisfied (determination as YES in S160), in S170, processing for updating the flow rate learning value which will be described later is performed, and thereafter the process returns to S140. When the learning condition has not been satisfied (determination as NO in S160), S170 is skipped and the process returns to S140. Thus, in the immediate hot water supply operation mode, determination as to detection of hot water supply interrupt in S140 is repeatedly made.

When flow rate detection value Q exceeds criterion value Qth continuously for a certain time period (for example, approximately 0.3 second), controller 10 makes determination as YES in S140, and detects hot water supply interrupt in S180. Furthermore, controller 10 deactivates circulation pump 80 in S190. Consequently, the immediate hot water supply operation mode is once quitted and the hot water supply operation is started. In this case, the process returns to S100. When the hot water supply operation is stopped and the temperature detected by temperature sensor 71 becomes lower than a predetermined temperature while the immediate hot water supply operation is being performed, the immediate hot water supply operation mode is started again in response to determination as YES in S100.

When the temperature detected by temperature sensor 71 increases while the immediate hot water supply operation mode is continued (S150) as well, the process proceeds to S190 as shown with a dotted line in the figure, and the immediate hot water supply operation mode is once quitted by deactivating circulation pump 80. In this case as well, as in detection of hot water supply interrupt, the process returns to S100.

Figure 5:
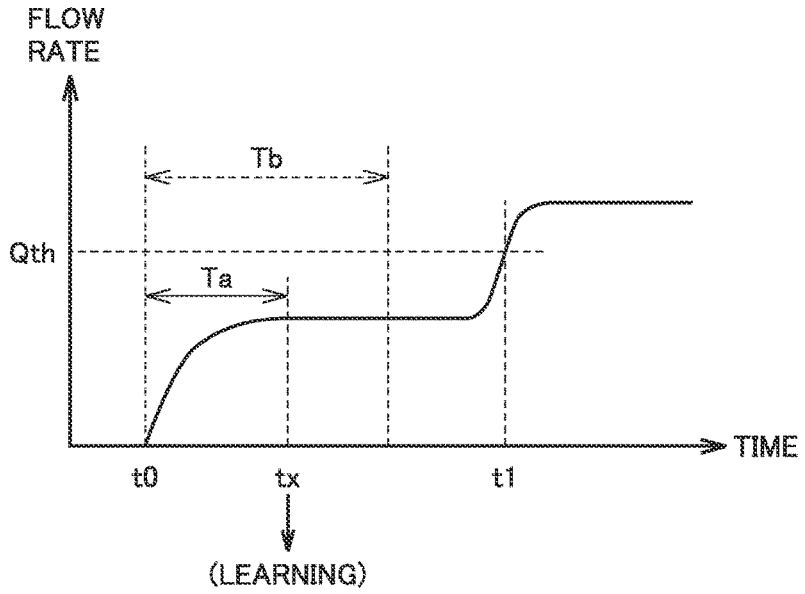
FIG. 5 shows a conceptual waveform diagram of a flow rate detection value in the immediate hot water supply operation mode.

FIG. 5 shows a conceptual waveform diagram of a flow rate detection value in the immediate hot water supply operation mode. The ordinate in FIG. 5 represents flow rate detection value Q obtained by flow rate sensor 81.

Figure 6:
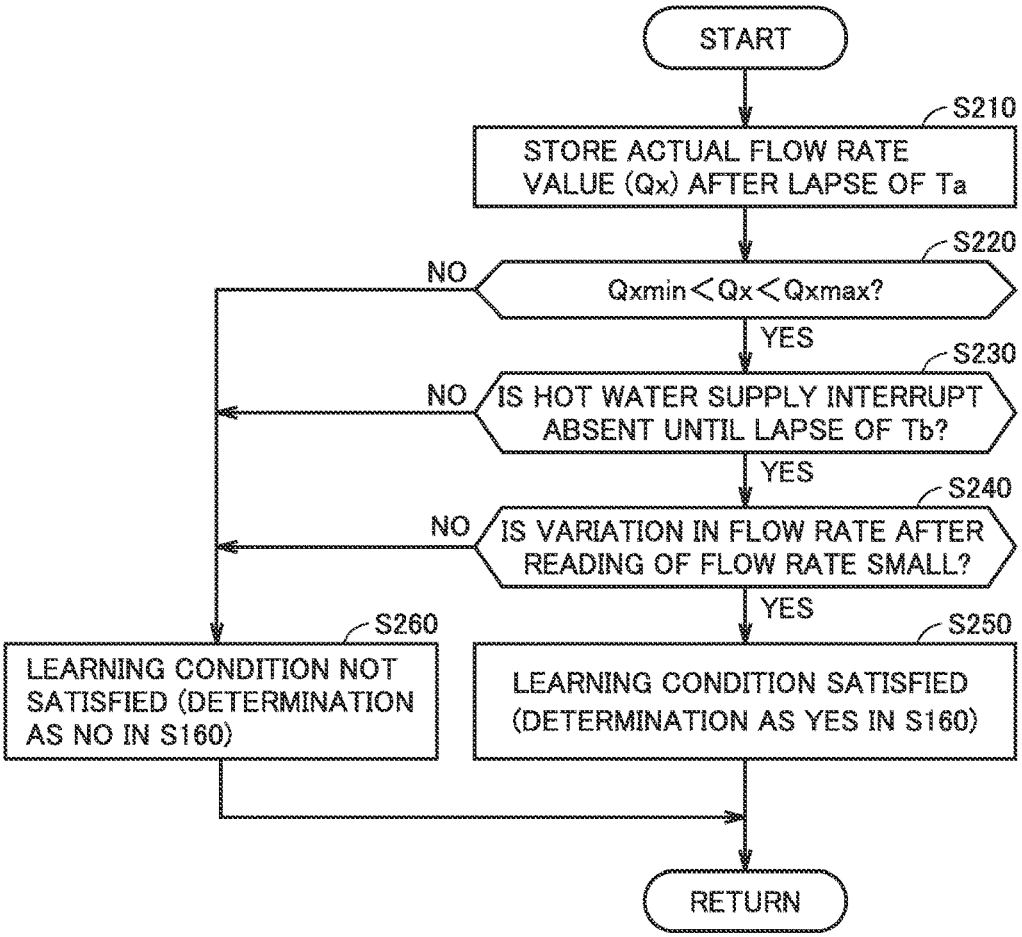
FIG. 6 is a flowchart illustrating processing for learning a flow rate detection value.

Referring to FIG. 5, at time t0, determination as YES is made in S100 (FIG. 4) and the immediate hot water supply operation mode is started. Since a temperature of retained fluid is low at the time point of start of the immediate hot water supply operation mode, crossover valve 200 is in such a state that the thermal bypass path has been formed by wax thermostatic element 210. Therefore, from time t0, the flow rate in the immediate hot water supply circulation path increases in response to activation of circulation pump 80 and flow rate detection value Q increases. During a period until a temperature of wax thermostatic element 210 increases to close the thermal bypass path, the flow rate in the immediate hot water supply circulation path (flow rate detection value Q) is substantially constant. Therefore, in order to learn flow rate detection value Q during that period, at timing (time tx) after lapse of a predetermined time period Ta (for example, approximately five seconds) since time t0, learning processing shown in FIG. 6 is started up. In the example in FIG. 5, after time tx, flow rate detection value Q exceeds criterion value Qth set in S120 in FIG. 4, and thus hot water supply interrupt is detected at time t1.

FIG. 6 is a flowchart illustrating processing for learning a flow rate detection value. The flowchart shown in FIG. 6 is started up at time tx.

Referring to FIG. 6, in S210, controller 10 stores flow rate detection value Q at time tx as an actual flow rate value Qx. Furthermore, controller 10 determines whether or not the learning condition has been satisfied in S220 to S240.

In S220, checking of actual flow rate value Qx against an upper limit and a lower limit is performed. For example, when relation of $Qxmin<Qx<Qxmax$ is satisfied based on comparison of a predetermined upper limit value Qxmax and a predetermined lower limit value Qxmin with actual flow rate value Qx (S210), determination as YES is made in S220, and otherwise, determination as NO is made in S220. When actual flow rate value Qx is out of the range between the upper limit and the lower limit (determination as NO in S220), in S260, learning using actual flow rate value Qx in S210 is not carried out.

In S230, by monitoring flow rate detection value Q at time tx or later, whether or not hot water supply interrupt is absent until lapse of a predetermined time period Tb ($Tb>Ta$, Tb being, for example, approximately ten seconds) since time t0 is determined. In the example in FIG. 5, since time t1 comes after lapse of prescribed time period Tb since time t0, determination as YES is made in S230.

Figure 7:
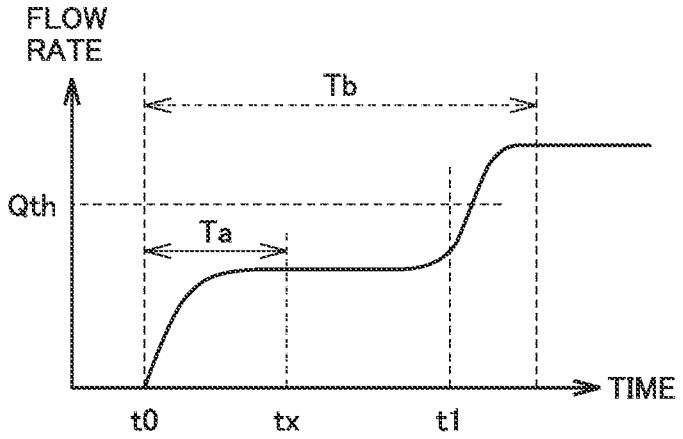
FIG. 7 shows a conceptual waveform diagram illustrating an example in which learning of a flow rate value is not carried out due to detection of hot water supply interrupt.

On the other hand, when Q is larger than Qth ($Q>Qth$) and hot water supply interrupt is detected before lapse of prescribed time period Tb since to as in the example in FIG. 7, determination as NO is made in S230.

In S240, whether or not change in flow rate detection value Q at time tx or later is equal to or smaller than a prescribed value is determined.

Figure 8:
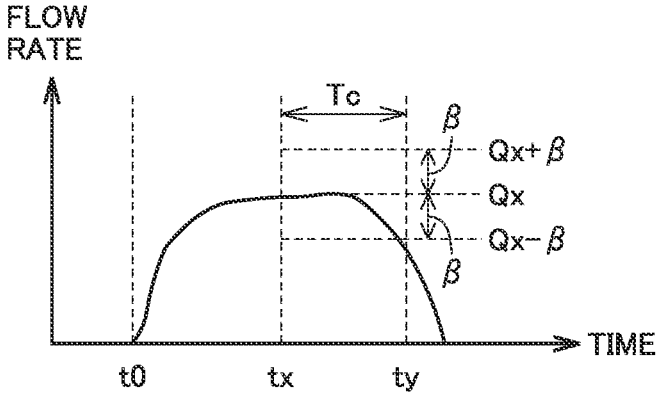
FIG. 8 shows a conceptual waveform diagram illustrating an example in which learning of a flow rate value is not carried out because variation in flow rate is great.

For example, as shown in FIG. 8, whether or not flow rate detection value Q at each timing is within a range of $Qx-\beta<Q<Qx+\beta$ until lapse of a predetermined time period Tc (for example, approximately four seconds) since time tx is determined by using a prescribed reference value β. When relation of $Qx-\beta<Q<Qx+\beta$ is maintained until lapse of Tc since time t0, determination as YES is made in S240.

When Q is smaller than $Qx-\beta$ ($Q<Qx-\beta$) at time ty before lapse of Tc since time tx as in the example in FIG. 8, on the other hand, determination as NO is made in S240.

Referring again to FIG. 6, when determination as YES is made in all of S220 to S240, it is determined in S250 that the learning condition has been satisfied and determination as YES is made in S160 (FIG. 4). Consequently, in S170 in FIG. 4, flow rate learning value Qln is updated by using actual flow rate value Qx (S210) stored in the present immediate hot water supply operation mode. Flow rate learning value Qln read in S110 in the next immediate hot water supply operation mode is thus updated. After S170 is performed, determination as NO is maintained in S160 until the immediate hot water supply operation mode is quitted.

When determination as NO is made in at least any one of S220 to S240 in FIG. 6, the process proceeds to S260 and determination as "No" is made in S160. When the immediate hot water supply operation mode ends without determination as YES in S160, learning using actual flow rate value Qx in S210 in the immediate hot water supply operation mode is not carried out. Flow rate learning value Qln read in S110 in the next immediate hot water supply operation mode does not change from the value read in S110 in the present immediate hot water supply operation mode.

Figure 9:
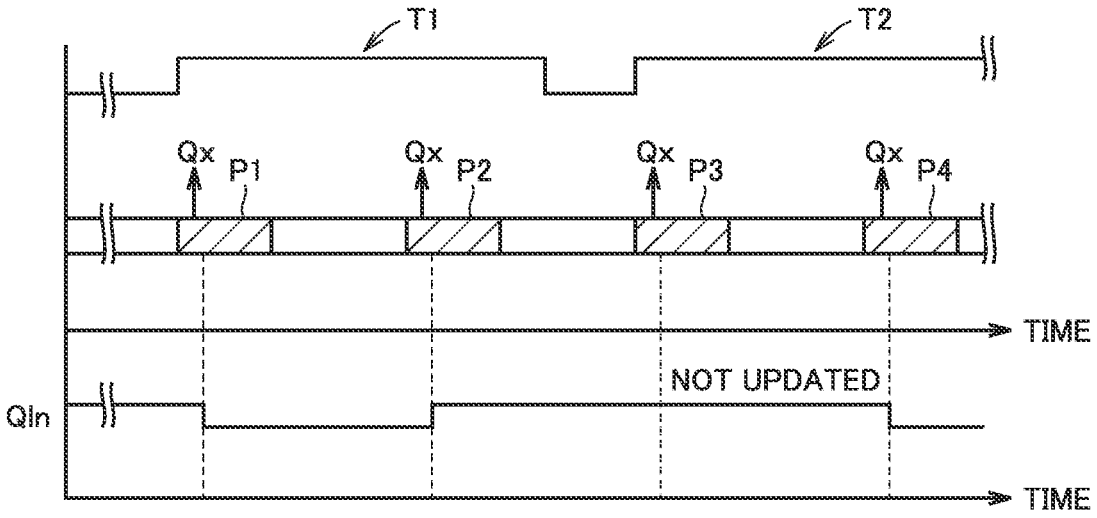
FIG. 9 is a conceptual diagram illustrating learning of a flow rate value in a circulation operation mode.

FIG. 9 shows a conceptual diagram illustrating learning of a flow rate value in a circulation operation mode.

Referring to FIG. 9, during a period set by the timer or the like for which the immediate hot water supply operation is performed, the immediate hot water supply operation mode is intermittently provided in such a manner as being started each time determination as YES is made in S100 and quitted by deactivation of circulation pump 80 in S190. In the example in FIG. 9, within periods T1 and T2 for which the immediate hot water supply operation is performed, the immediate hot water supply operation mode is provided for periods P1 to P4.

During each of periods P1 to P4, at timing corresponding to time tx in FIG. 5, actual flow rate value Qx is read. Thereafter, in accordance with determination in S220 to S240 in FIG. 6, for example, the flow rate learning value is updated (S170) during periods P1, P2, and P4, whereas flow rate learning value Qln is not updated during period P3 because determination as YES is not made in all of S220 to S240.

Flow rate learning value Qln is calculated based on a plurality of actual flow rate values Qx including actual flow rate value Qx in the immediate hot water supply operation mode in which processing for updating the learning value is performed and actual flow rate value Qx in the immediate hot water supply operation mode in the past. Preferably, flow rate learning value Qln can be calculated as an exponential moving average value in accordance with an expression (1) below:

$$Qln^{*}=(N\times Qln+Qx)/(N+1) \quad (1)$$

where Qln* represents an updated flow rate learning value, Qln represents a current (yet-to-be-updated) flow rate learning value, and Qx represents an actual flow rate value stored in the immediate hot water supply operation mode in which processing for updating the learning value is performed. N (N>0) represents a smoothing factor. As N is greater, a speed of reflection of a new actual flow rate value Qx on a flow rate learning value (learning speed) is lower.

An initial value for learning value Qln can be set by writing a standard value into memory 16 of controller 10 at the time of shipment from the factory. Alternatively, an initial value can be set also by writing a standard value adapted to crossover valve 200 into memory 16 by performing a predetermined specific operation onto remote controller 92 at the time of works for attachment of crossover valve 200.

Updated flow rate learning value Qln* is preferably checked against upper and lower limits. For example, in S170, in checking against a predetermined upper limit value Qlnmax and a predetermined lower limit value Qlnmin, when Qln* calculated in accordance with the expression (1) is larger than upper limit value Qlnmax (Qln*>Qlnmax), Qln* is corrected to Qln*=Qlnmax. Similarly, when Qln* calculated in accordance with the expression (1) is smaller than lower limit value Qlnmin (Qln*<Qlnmin), Qln* is corrected to Qln*=Qlnmin.

As described above, in water heating system 1A described with reference to FIG. 1, even when a flow rate in the immediate hot water supply circulation path formed to include the thermal bypass path formed by wax thermostatic element 210 of crossover valve 200 changes over time, such change in flow rate can appropriately be reflected on a criterion value for detection of hot water supply interrupt through learning of the flow rate value. Therefore, accuracy in detection of use of the hot water supply faucet in the immediate hot water supply operation in water heating system 1A can be improved.

Determination as to hot water supply interrupt based on a flow rate learning value can be made only based on the flow rate detection value obtained by flow rate sensor 81 without using a flow rate detection value obtained by flow rate sensor 82 arranged in circulation path 28. Consequently, flow rate sensor 82 unnecessary in the hot water supply operation does not have to be arranged.

In S120 in FIG. 4, criterion value Qth (S120) is set preferably to a value larger than flow rate learning value Qln (S110), such as Qth=Qln+α. As described above, in the immediate hot water supply operation mode, flow rate regulation valve 90 is controlled to minimize the bypass flow rate ratio. Therefore, when transition to the hot water supply operation is made while the flow rate is low, the flow rate detection value obtained by flow rate sensor 81 may be equal to or smaller than the minimum operating quantity (MOQ) of working water and combustion mechanism 30 may not be activated. Therefore, by setting criterion value Qth beyond which transition is made from the immediate hot water supply operation mode to the hot water supply operation to be high to some extent, combustion mechanism 30 can reliably be activated immediately after detection of hot water supply interrupt.

By taking into account variation in flow rate for a factor different from a factor for change in flow rate in the immediate hot water supply circulation path by using S220 to S240 in the learning processing in FIG. 6, incorrect learning of flow rate learning value Qln can be suppressed.

In water heating system 1A according to the present embodiment, an abnormal condition of the immediate hot water supply circulation path can also be diagnosed based on the flow rate learning value described above.

Figure 10:
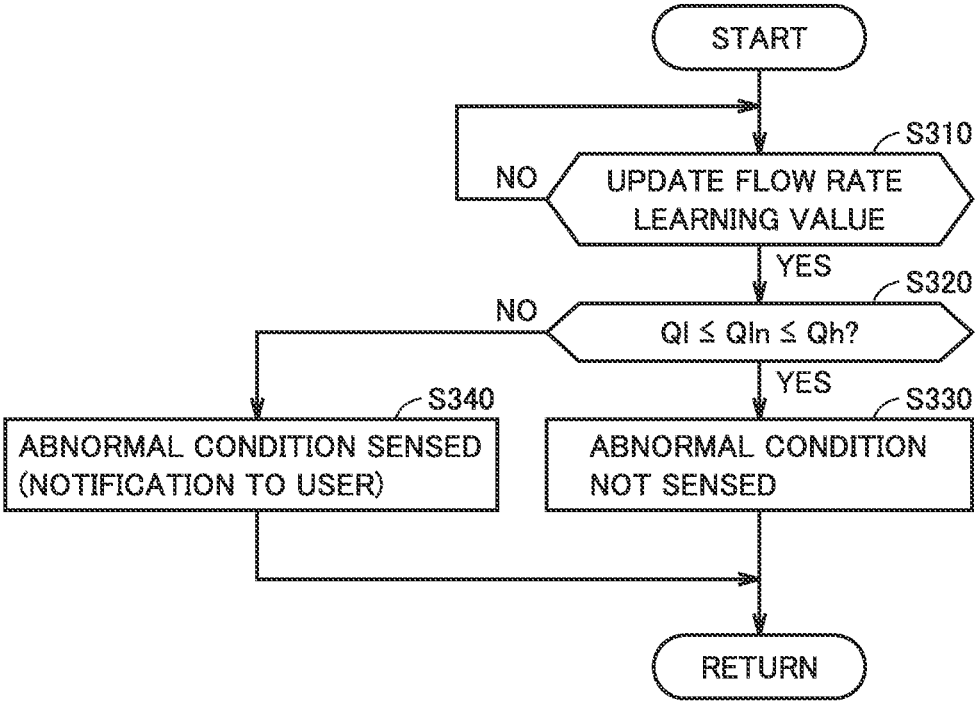
FIG. 10 is a flowchart illustrating diagnosis of an abnormal condition in an immediate hot water supply circulation path in the water heating system according to the present embodiment.

FIG. 10 is a flowchart illustrating diagnosis of an abnormal condition in the immediate hot water supply circulation path in the water heating system according to the present embodiment.

Referring to FIG. 10, when the flow rate learning value is updated in S170 (FIG. 4), controller 10 makes determination as YES in S310, and makes abnormal condition diagnosis in S320 or later. Controller 10 determines in step S320 whether or not updated flow rate learning value Qln is within a predetermined normal range (Ql to Qh).

When the bypass flow path is clogged in crossover valve 200, the flow rate in the immediate hot water supply circulation path becomes lower than the normal range. When breakage occurs in crossover valve 200, on the other hand, the flow rate in the immediate hot water supply circulation path becomes higher than the normal range.

Therefore, when a condition of Qln<Ql or Qln>Qh is satisfied (determination as NO in S320), controller 10 senses an abnormal condition of the immediate hot water supply circulation path in S340. In S340, a user is preferably notified of sensing of the abnormal condition through notification apparatus 95. In this case, different information can be given between the condition of Qln<Ql and the condition of Qln>Qh.

When a condition of Ql≤Qln≤Qh is satisfied (determination as YES in S320), controller 10 does not sense an abnormal condition of the immediate hot water supply circulation path in S330. Lower limit value Ql and upper limit value Qh of the normal range may be common to lower limit value Qlnmin and upper limit value Qlnmax in checking of the flow rate learning value against the upper limit and the lower limit described above, respectively, or may separately be set.

Thus, in the water heating system according to the present embodiment, an abnormal condition in the immediate hot water supply circulation path can be diagnosed based on the flow rate learning value in the immediate hot water supply operation mode. In particular, by making determination based on the flow rate learning value, abnormal condition diagnosis that achieves suppressed erroneous detection of the abnormal condition at the time of detection of a sporadic abnormal value due to temporary malfunction of crossover valve 200 can be realized.

A modification of the configuration of the water heating system to which detection of hot water supply interrupt in the immediate hot water supply operation mode can be applied according to the present embodiment will now further be described.

Figure 11:
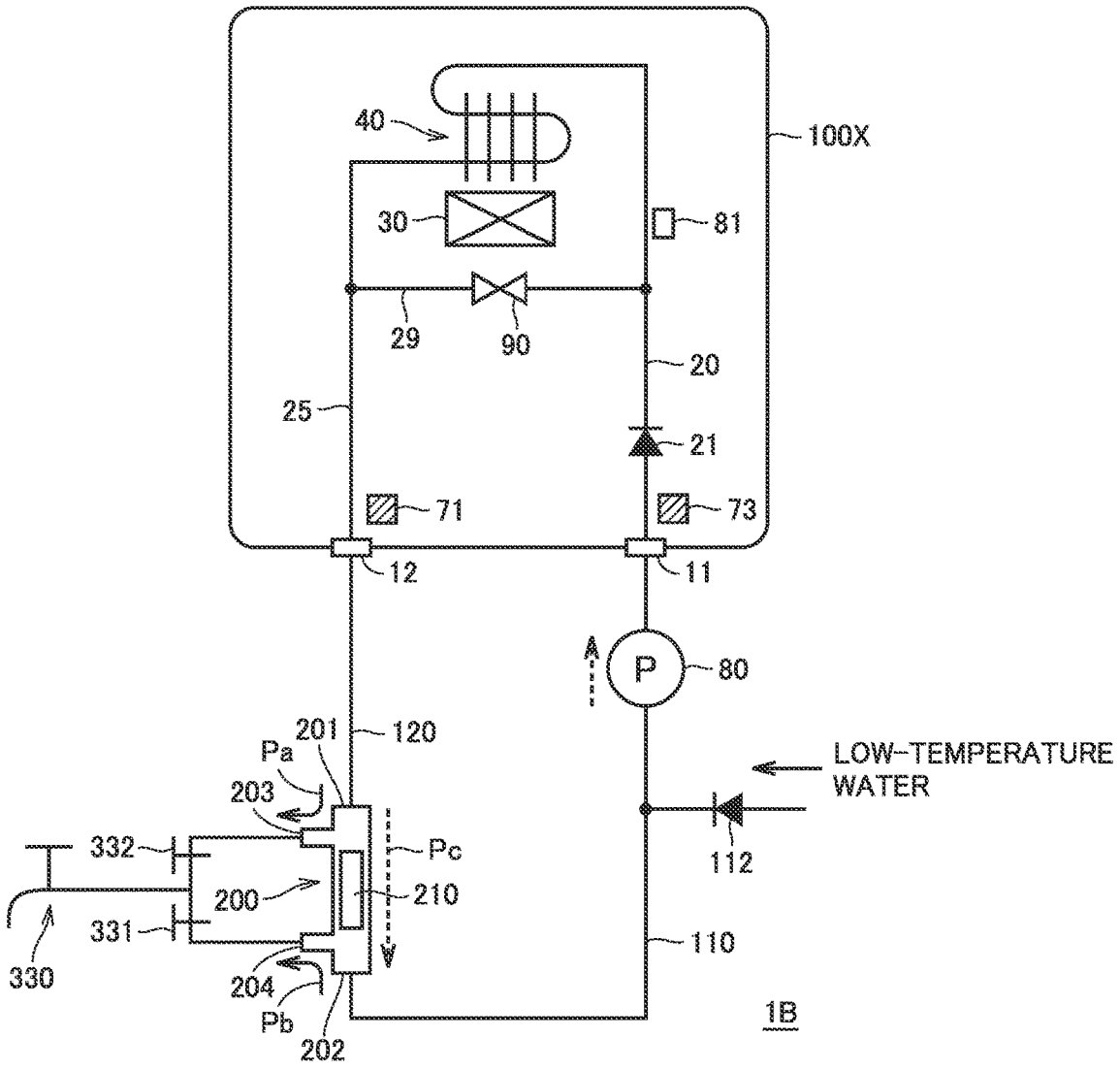
FIG. 11 is a block diagram illustrating a first modification of the configuration of the water heating system according to the present embodiment.

FIG. 11 shows a block diagram illustrating a first modification of the configuration of the water heating system according to the present embodiment.

Referring to FIG. 11, a water heating system 1B includes a water heating apparatus 100X, low-temperature water pipe 110, high-temperature water pipe 120, and crossover valve 200. Water heating apparatus 100X includes water entry port 11 and hot water output port 12 without including circulation port 13. Therefore, unlike water heating apparatus 100 in FIG. 1, no circulation path 28 is provided in the inside of water heating apparatus 100X.

Low-temperature water pipe 110 supplied with low-temperature water through check valve 112 has a first end connected to water entry port 11 of water heating apparatus 100X and a second end connected to port 202 of crossover valve 200. Connection of crossover valve 200 to low-temperature water pipe 110, high-temperature water pipe 120, and hot water supply faucet 330 is the same as in water heating system 1A shown in FIG. 1. Circulation pump 80 is connected to water entry port 11.

In water heating system 1B, during the hot water supply operation, at least some of low-temperature water introduced from low-temperature water pipe 110 into water entry port 11 is heated by the heating mechanism (combustion mechanism 30 and heat exchanger 40). High-temperature water obtained by heating is output from hot water supply faucet 330 through hot water output port 12 and high-temperature water pipe 120 as well as crossover valve 200 (flow path Pa) as in water heating system 1A. Water heating apparatus 100X can thus perform the hot water supply operation similarly to water heating apparatus 100.

In the immediate hot water supply operation mode, as circulation pump 80 is activated while the faucet is closed, a fluid path (outer path) from hot water output port 12 through high-temperature water pipe 120, crossover valve 200 (thermal bypass path Pc), and low-temperature water pipe 110 to water entry port 11 can be formed on the outside of water heating apparatus 100X. In addition, an inner path that passes through water entry port 11, water entry path 20, heat exchanger 40 (heating mechanism), hot water output path 25, and hot water output port 12 can be formed in the inside of water heating apparatus 100X as in FIG. 1. The immediate hot water supply circulation path can be formed by the inner path and the outer path also in water heating system 1B. In the immediate hot water supply operation mode, flow rate sensor 81 can detect a flow rate in the immediate hot water supply circulation path and temperature sensor 73 can detect a temperature of fluid in the immediate hot water supply circulation path.

In water heating system 1B as well, a behavior of the flow rate detection value obtained by flow rate sensor 81 is similar to the behavior in water heating system 1A. Therefore, hot water supply interrupt during the immediate hot water supply operation can be detected in accordance with the control processing in FIGS. 4 and 6. Furthermore, abnormal condition diagnosis based on the flow rate learning value can also be made in accordance with the control processing in FIG. 10 as in water heating system 1A.

Crossover valve 200 described in U.S. Pat. No. 6,536,464 and shown in the present embodiment is merely an exemplary "thermal water stop bypass valve" and a valve containing a thermal bypass path of which formation and closing are switched depending on a temperature could be employed instead of crossover valve 200 in the present embodiment.

Detection of hot water supply interrupt in the immediate hot water supply operation mode according to the present embodiment can be applied also to a water heating system configured such that the immediate hot water supply circulation path is disposed by disposing a circulation pipe without crossover valve 200 (that is, the "thermal water stop bypass valve").

Figure 12:
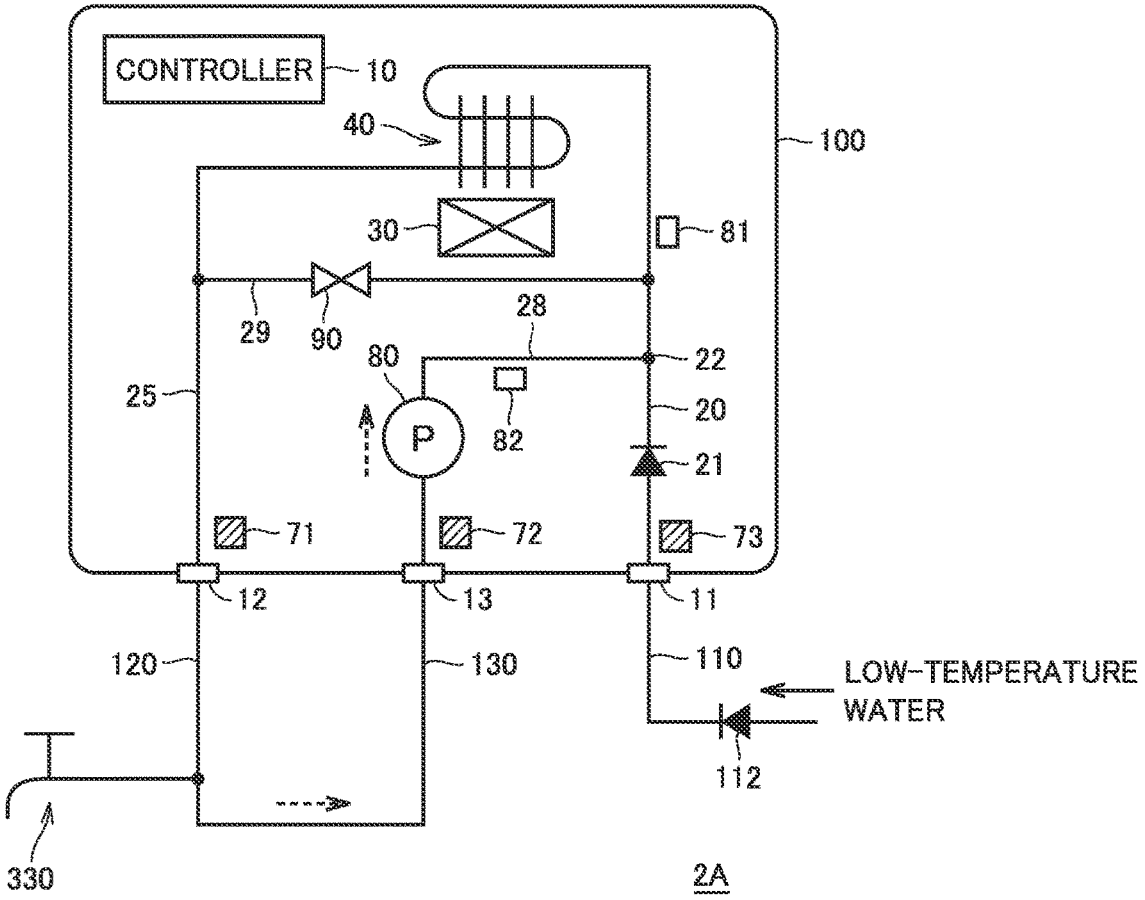
FIG. 12 is a block diagram illustrating a second modification of the configuration of the water heating system according to the present embodiment.

FIG. 12 shows a block diagram illustrating a second modification of the configuration of the water heating system according to the present embodiment.

Referring to FIG. 12, a water heating system 2A includes water heating apparatus 100 as in FIG. 1, low-temperature water pipe 110, high-temperature water pipe 120, and circulation pipe 130. Crossover valve 200 shown in FIG. 1 is not externally connected to water heating apparatus 100.

As in FIG. 1, low-temperature water pipe 110 supplied with low-temperature water through check valve 112 is connected to water entry port 11 and high-temperature water pipe 120 connects hot water output port 12 and hot water supply faucet 330 to each other. Circulation pipe 130 connects high-temperature water pipe 120 and circulation port 13 to each other.

By activating circulation pump 80 while the faucet is closed also in water heating system 2A, a fluid path (inner path) as in water heating system 1A can be formed in the inside of water heating apparatus 100. In addition, a fluid path (outer path) that includes hot water output port 12, high-temperature water pipe 120, circulation pipe 130, and circulation port 13 and bypasses hot water supply faucet 330 can be formed on the outside of water heating apparatus 100. Consequently, the immediate hot water supply circulation path can be formed by the inner path and the outer path, and hence the immediate hot water supply operation mode as in water heating system 1A can be executed.

In water heating system 2A as well, hot water supply interrupt in the immediate hot water supply operation mode can be detected by learning the flow rate detection value obtained by flow rate sensor 81 in the immediate hot water supply operation mode in accordance with the control processing in FIGS. 4 and 6. Thus, change over time in the immediate hot water supply circulation path can be reflected and accuracy in detection of use of the hot water supply faucet in the immediate hot water supply operation can be improved without flow rate sensor 82 in circulation path 28. An abnormal condition in the immediate hot water supply circulation path can also be diagnosed based on the flow rate learning value in the immediate hot water supply operation mode.

Figure 13:
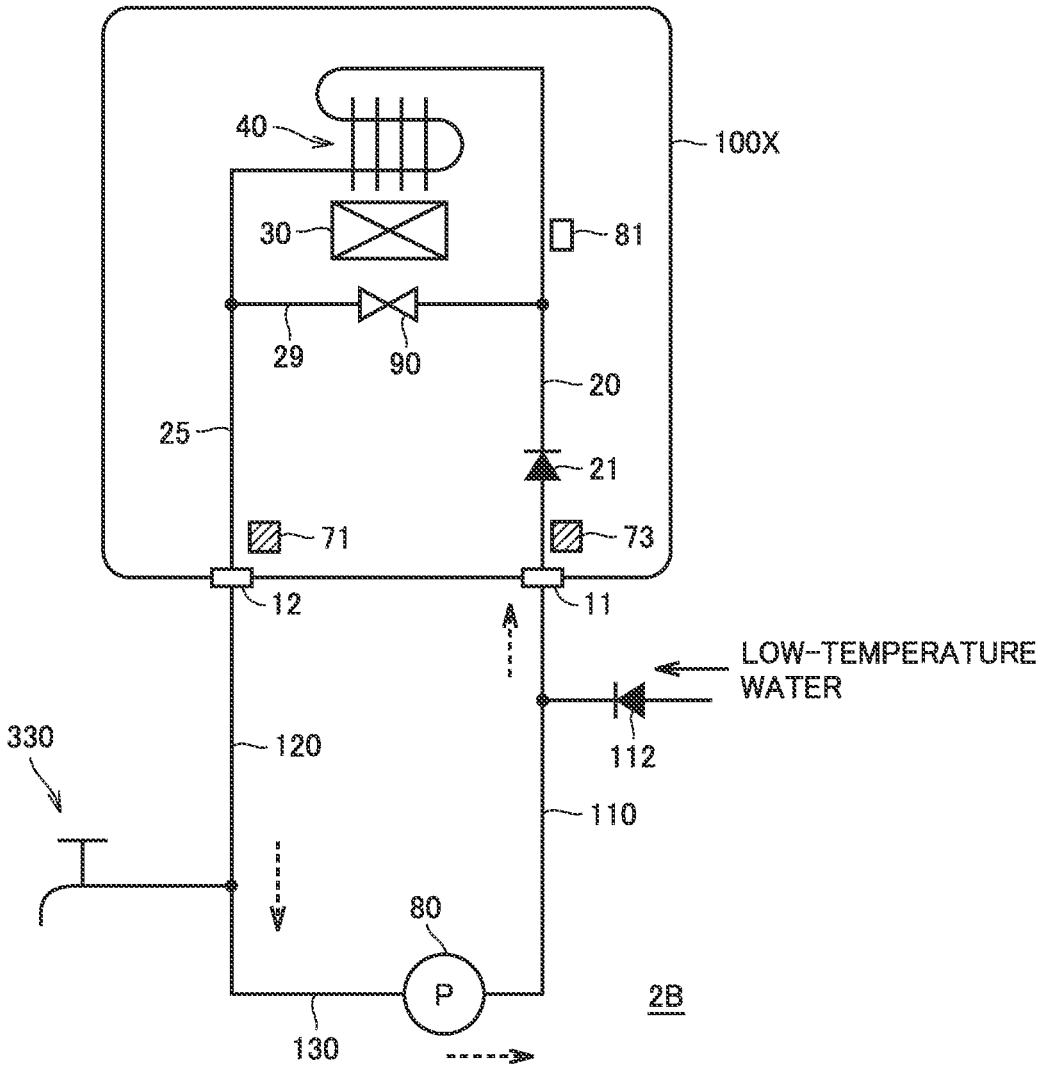
FIG. 13 is a block diagram illustrating a third modification of the configuration of the water heating system according to the present embodiment.

FIG. 13 shows a block diagram illustrating a third modification of the configuration of the water heating system according to the present embodiment.

Referring to FIG. 13, a water heating system 2B includes water heating apparatus 100X as in FIG. 11, low-temperature water pipe 110, high-temperature water pipe 120, and circulation pipe 130. Crossover valve 200 shown in FIG. 11 is not externally connected to water heating apparatus 100X.

As in FIG. 11, low-temperature water pipe 110 supplied with low-temperature water through check valve 112 is connected to water entry port 11 of water heating apparatus 100X and high-temperature water pipe 120 connects hot water output port 12 of water heating apparatus 100X and hot water supply faucet 330 to each other. Circulation pipe 130 connects high-temperature water pipe 120 and low-temperature water pipe 110 to each other.

Circulation pump 80 can be connected to circulation pipe 130. During the hot water supply operation in which circulation pump 80 is deactivated, as hot water supply faucet 330 is opened, at least some of low-temperature water introduced from low-temperature water pipe 110 into water entry port 11 is heated by the heating mechanism (combustion mechanism 30 and heat exchanger 40). High-temperature water obtained by heating is output from hot water supply faucet 330 through hot water output port 12 and high-temperature water pipe 120. Water heating system 2B can thus also perform the hot water supply operation by water heating apparatus 100X.

By activating circulation pump 80 while the faucet is closed also in water heating system 2B, a fluid path (inner path) as in water heating system 1B can be formed in the inside of water heating apparatus 100X. In addition, a fluid path (outer path) that extends from hot water output port 12 through high-temperature water pipe 120, circulation pipe 130, and low-temperature water pipe 110 to water entry port 11 and bypasses hot water supply faucet 330 can be formed on the outside of water heating apparatus 100X. Consequently, the immediate hot water supply circulation path can be formed also in water heating system 2B. By forming the immediate hot water supply circulation path by the inner path and the outer path, the immediate hot water supply operation mode the same as described in connection with water heating system 1A can be executed.

In water heating system 2B as well, hot water supply interrupt in the immediate hot water supply operation mode can be detected by learning the flow rate detection value obtained by flow rate sensor 81 in the immediate hot water supply operation mode in accordance with the control processing in FIGS. 4 and 6. Thus, change over time in the immediate hot water supply circulation path can be reflected and accuracy in detection of use of the hot water supply faucet during the immediate hot water supply operation can be improved without flow rate sensor 82 in circulation path 28. An abnormal condition in the immediate hot water supply circulation path can also be diagnosed based on the flow rate learning value in the immediate hot water supply operation mode.

In water heating systems 1A, 1B, 2A, and 2B, so long as the immediate hot water supply circulation path as above can be formed, circulation pump 80 can be arranged at any position on the outside or in the inside of water heating apparatus 100 without being limited to the configuration in the illustration in FIGS. 1 and 11 to 13. Even in such a configuration that circulation pump 80 is not contained in water heating apparatus 100, the immediate hot water supply operation mode described in the present embodiment can be realized by including controller 10 that controls deactivation and activation of circulation pump 80.

Though an example in which water heating apparatuses 100 and 100X each include a bypass configuration (bypass path 29 and flow rate regulation valve 90) is described in the present embodiment, detection of hot water supply interrupt and diagnosis of an abnormal condition of the immediate hot water supply circulation path based on the flow rate learning value detected by flow rate sensor 81 in the immediate hot water supply operation mode described in the present embodiment can be applied also to the configuration of water heating apparatuses 100 and 100X from which the bypass configuration is excluded. In this case, the flow rate detection value obtained by flow rate sensor 81 is always equal to the flow rate in the immediate hot water supply circulation path.

Though embodiments of the present invention have been described, it should be understood that the embodiments disclosed herein are illustrative and non-restrictive in every respect. The scope of the present invention is defined by the terms of the claims and is intended to include any modifications within the scope and meaning equivalent to the terms of the claims.

What is claimed is:

1. A water heating apparatus that outputs hot water to a hot water supply faucet, the water heating apparatus comprising:

a water entry port to which low-temperature water is introduced;

a heating mechanism;

a water entry path formed between the water entry port and the heating mechanism;

a hot water output port for output of high-temperature water heated by the heating mechanism;

a hot water output path formed between the heating mechanism and the hot water output port, in an immediate hot water supply operation mode in which a circulation pump arranged inside or outside of the water heating apparatus is activated while the hot water supply faucet is closed, the water heating apparatus being configured to form an immediate hot water supply circulation path through which fluid passes through the heating mechanism by an inner path and an outer path as being combined, the inner path including at least a part of the water entry path, the heating mechanism, and the hot water output path, the outer path bypassing the hot water supply faucet on outside of the water heating apparatus;

a flow rate detector that detects a flow rate in the immediate hot water supply circulation path; and a controller that gives an instruction to activate and deactivate the heating mechanism and the circulation pump, wherein the controller stores as an actual flow rate value for each immediate hot water supply operation mode, a flow rate detection value obtained by the flow rate detector at predetermined timing in the immediate hot water supply operation mode, and calculates a flow rate learning value based on a plurality of stored actual flow rate values, and when the stored actual flow rate value is not within a range between predetermined upper and lower limits in each immediate hot water supply operation mode, the controller does not reflect the actual flow rate value on calculation of the flow rate learning value and, when the flow rate detection value becomes larger than a criterion value set in accordance with the flow rate learning value calculated based on previous flow rate detection values that are obtained prior to the flow rate detection value in the immediate hot water supply operation mode, detects use of the hot water supply faucet and deactivates the circulation pump.

2. The water heating apparatus according to claim 1, wherein the controller calculates the flow rate learning value in accordance with an exponential moving average value of successively stored actual flow rate values.

3. A water heating apparatus that outputs hot water to a hot water supply faucet, the water heating apparatus comprising:

a water entry port to which low-temperature water is introduced;

a heating mechanism;

a water entry path formed between the water entry port and the heating mechanism;

a hot water output port for output of high-temperature water heated by the heating mechanism;

a hot water output path formed between the heating mechanism and the hot water output port, in an immediate hot water supply operation mode in which a circulation pump arranged inside or outside of the water heating apparatus is activated while the hot water supply faucet is closed, the water heating apparatus being configured to form an immediate hot water supply circulation path through which fluid passes through the heating mechanism by an inner path and an outer path as being combined, the inner path including at least a part of the water entry path, the heating mechanism, and the hot water output path, the outer path bypassing the hot water supply faucet on outside of the water heating apparatus;

a flow rate detector that detects a flow rate in the immediate hot water supply circulation path; and a controller that gives an instruction to activate and deactivate the heating mechanism and the circulation pump, wherein the controller stores as an actual flow rate value for each immediate hot water supply operation mode, a flow rate detection value obtained by the flow rate detector at predetermined timing in the immediate hot water supply operation mode, and calculates a flow rate learning value based on a plurality of stored actual flow rate values, wherein when change in flow rate detection value is larger than a predetermined value during a period from timing of storage of the actual flow rate value until lapse of a prescribed time period in each immediate hot water supply operation mode, the controller does not reflect the actual flow rate value on calculation of the flow rate learning value and, when the flow rate detection value becomes larger than a criterion value set in accordance with the flow rate learning value calculated based on previous flow rate detection values that are obtained prior to the flow rate detection value in the immediate hot water supply operation mode, detects use of the hot water supply faucet and deactivates the circulation pump.

4. The water heating apparatus according to claim 1, further comprising:

a bypass path that connects the water entry path and the hot water output path to each other as bypassing the heating mechanism; and a flow rate regulation valve that controls a ratio of a flow rate in the bypass path to a total flow rate in the heating mechanism and the bypass path, wherein the controller fixes the ratio of the flow rate to a predetermined identical value in each immediate hot water supply operation mode.

5. The water heating apparatus according to claim 1, wherein the criterion value is set to be larger than the flow rate learning value.

6. The water heating apparatus according to claim 1, wherein when the flow rate learning value is out of a range between predetermined upper and lower limits, the controller senses an abnormal condition of the immediate hot water supply circulation path.

7. The water heating apparatus according to claim 1, wherein the immediate hot water supply circulation path is formed to include a thermal water stop bypass valve connected between a low-temperature water pipe connected to the water entry port and a high-temperature water pipe connected to the hot water output port, and the hot water supply faucet, the thermal water stop bypass valve includes a thermal bypass path formed between the low-temperature water pipe and the high-temperature water pipe in a low-temperature state, and the thermal bypass path is closed in a high-temperature state.

8. A water heating system comprising:

a water heating apparatus including a water entry port and a hot water output port;

a low-temperature water pipe that introduces low-temperature water to the water entry port of the water heating apparatus;

a high-temperature water pipe that connects the hot water output port of the water heating apparatus and a hot water supply faucet to each other; and a circulation pump arranged inside or outside the water heating apparatus, the water heating apparatus including a heating mechanism, a water entry path formed between the water entry port and the heating mechanism, a hot water output path formed between the heating mechanism and the hot water output port, in an immediate hot water supply operation mode in which the circulation pump is activated while the hot water supply faucet is closed, the water heating apparatus being configured to form an immediate hot water supply circulation path through which fluid passes through the heating mechanism by an inner path and an outer path as being combined, the inner path including at least a part of the water entry path, the heating mechanism, and the hot water output path, the outer path bypassing the hot water supply faucet on outside of the water heating apparatus, a flow rate detector that detects a flow rate in the immediate hot water supply circulation path, and a controller that gives an instruction to activate and deactivate the heating mechanism and the circulation pump, wherein the controller stores as an actual flow rate value for each immediate hot water supply operation mode, a flow rate detection value obtained by the flow rate detector at predetermined timing in the immediate hot water supply operation mode, and calculates a flow rate learning value based on a plurality of stored actual flow rate values, and when the stored actual flow rate value is not within a range between predetermined upper and lower limits in each immediate hot water supply operation mode, the controller does not reflect the actual flow rate value on calculation of the flow rate learning value and, when the flow rate detection value becomes larger than a criterion value set in accordance with the flow rate learning value calculated based on previous flow rate detection values that are obtained prior to the flow rate detection value in the immediate hot water supply operation mode, detects use of the hot water supply faucet and deactivates the circulation pump.

9. The water heating system according to claim 8, further comprising a thermal water stop bypass valve connected between the low-temperature water pipe and the high-temperature water pipe, and the hot water supply faucet, wherein the thermal water stop bypass valve includes a thermal bypass path formed between the low-temperature water pipe and the high-temperature water pipe in a low-temperature state, and the thermal bypass path is closed in a high-temperature state.

10. The water heating apparatus according to claim 3, wherein the controller calculates the flow rate learning value in accordance with an exponential moving average value of successively stored actual flow rate values.

11. The water heating apparatus according to claim 3, wherein the criterion value is set to be larger than the flow rate learning value.

12. The water heating system according to claim 8, wherein the controller calculates the flow rate learning value in accordance with an exponential moving average value of successively stored actual flow rate values.

13. The water heating system according to claim 8, wherein the criterion value is set to be larger than the flow rate learning value.

* * * * *